US005976359A

United States Patent [19]

Parker

[11] Patent Number: 5,976,359

[45] Date of Patent: Nov. 2, 1999

[54] METHODS FOR REDUCING THE CONCENTRATION OF AMINES IN PROCESS AND HYDROCARBON FLUIDS

[75] Inventor: Wiley L. Parker, Conroe, Tex.

[73] Assignee: BetzDearborn Inc., Trevose, Pa.

[21] Appl. No.: 09/079,598

[22] Filed: May 15, 1998

[51] Int. Cl.[6] ..... C10G 7/10; C10G 75/00

[52] U.S. Cl. ..... 208/254 R; 208/47; 208/48 AA; 208/48 R; 208/256; 208/281; 208/284; 208/348

[58] Field of Search ..... 208/47, 48 R, 208/48 AA, 254 R, 256, 258, 281, 284, 289, 348

[56] References Cited

U.S. PATENT DOCUMENTS

| | | | |
|---|---|---|---|
| 4,232,175 | 11/1980 | Smith et al. | 568/706 |
| 5,087,671 | 2/1992 | Loeppky et al. | 525/328.2 |
| 5,211,840 | 5/1993 | Lehrer et al. | 208/348 |
| 5,283,006 | 2/1994 | Lehrer et al. | 252/392 |

*Primary Examiner*—Bekir L. Yildirim
*Attorney, Agent, or Firm*—Philip H. Von Neida

[57] ABSTRACT

Disclosed is a method for reducing the concentration of amines in hydrocarbon fluids and process streams by generating therein a nitrosating agent. The nitrosating agent will react with the amines to form innocuous by-products under refinery process conditions.

13 Claims, No Drawings

METHODS FOR REDUCING THE CONCENTRATION OF AMINES IN PROCESS AND HYDROCARBON FLUIDS

FIELD OF THE INVENTION

The present invention relates to methods for reducing the concentration of amines in process and hydrocarbon fluids using nitrous acid.

BACKGROUND OF THE INVENTION

Hydrocarbon feedstocks such as petroleum crudes, gas oil, etc. are subjected to various processes in order to isolate and separate different fractions of the feedstock. In refinery processes, the feedstock is distilled so as to provide light hydrocarbons, gasoline, naphtha, kerosene, gas oil, etc.

The lower boiling fractions are recovered as an overhead fraction from the distillation column. The intermediate components are recovered as side cuts from the distillation column. The fractions are cooled, condensed, and sent to collecting equipment. No matter what type of petroleum feedstock is used as the charge, the distillation equipment is subjected to the corrosive activity of acids such as $H_2S$, HCl, organic acids, and $H_2CO_3$.

Corrosive attack on the metals normally used in the low temperature sections of a refinery process system, (i.e. where water is present below its dew point) is an electrochemical reaction generally in the form of acid attack on active metals in accordance with the following equations:
at the anode $$Fe(s) \rightarrow Fe^{++} + 2e^- \quad (1)$$

at the cathode $$2H^+ + 2e^- \rightarrow 2H \text{ (surface)}$$

$$2H \text{ (surface)} \rightarrow H_2 \text{ (gas)} \quad (2)$$

The aqueous phase may be water entrained in the hydrocarbons being processed and/or water added to the process for such purposes as steam stripping. Acidity of the condensed water is due to dissolved acids in the condensate, principally HCl, organic acids, $H_2S$, and $H_2CO_3$. HCl, the most trouble some corrosive material, is primarily formed by hydrolysis of organic amine salts, and calcium and magnesium chlorides originally present in the brines.

Corrosion may occur on the metal surface of fractionating towers such as crude towers, trays within the towers, heat exchangers, etc. The most troublesome locations for corrosion are tower top trays, overhead lines, condensers, and top pump around exchangers. It is usually within these areas that water condensate is formed or carried along with the process stream. The top temperature of the fractionating column is usually, but not always, maintained at about or above the dew point of water. The aqueous condensate formed contains a significant concentration of the acidic components above-mentioned. These high concentrations of acidic components render the pH of the condensate highly acidic and, of course, dangerously corrosive. Accordingly, neutralizing treatments have been used to render the pH of the condensate more alkaline to thereby minimize acid-based corrosive attack at those regions of the apparatus with which this condensate is in contact.

In the past, highly basic ammonia has been added at various points in the distillation circuit in an attempt to control the corrosiveness of condensed acidic materials. Ammonia, however, has not proven to be effective with respect to eliminating corrosion occurring at the initial condensate. It is believed that ammonia has been ineffective for this purpose because it does not condense completely enough to neutralize the acidic components of the first condensate.

For example, amines such as ethanolamine, morpholine, methoxypropylamine, ethylenediamine (EDA), dimethyl isopropylamine (DMIPA), dimethylethylamine (DMEA), etc. are used successfully to control or inhibit corrosion that ordinarily occurs at the point of initial condensation within or after the distillation unit. The addition of these amines to the petroleum fractionating system substantially raises the pH of the initial condensate rendering the material noncorrosive or substantially less corrosive than was previously possible. The inhibitor can be added to the system either in pure form or as an aqueous solution. A sufficient amount of inhibitor is added to raise the pH of the liquid at the point of initial condensation to above 4.5 and, preferably, to between 5.5 and 6.0.

Commercially, morpholine and methoxypropylamine have proven to be successful in treating many crude distillation units. In addition, other highly basic (pKa>8) amines have been used, including ethylenediamine and monethanolamine. Another commercial product that has been used in these applications is hexamethylenediamine.

A specific problem has developed in connection with the use of these highly basic amines for treating the initial condensate. This problem relates to the hydrochloride salts of these amines which tend to form deposits in distillation columns, column pumparounds, overhead lines, and in overhead heat exchangers. These deposits manifest themselves after the particular amine has been used for a period of time, sometimes in as little as one or two days. These deposits can cause both fouling and corrosion problems and are most problematic in units that do not use a water wash.

DESCRIPTION OF THE PREFERRED EMBODIMENT

The present invention provides for methods for reducing the amount of amine compounds present in hydrocarbon fluids and process waters during the processing of hydrocarbons comprising generating a nitrosating agent in the hydrocarbon fluid or process water.

It has been discovered that by forming a nitrosating agent in the hydrocarbon fluid or process water that they will react with the amines present in those streams to form possibly innocuous by-products under refinery processing conditions.

A nitrosating agent is an agent that will create an ester of a nitrogenous acid. These agents include but are not limited to nitrous acid, peroxynitrous acid, nitrous acid complexes, organic nitrites, nitroprusside, NO, $NO_2$. $NO_3$, etc.

The generation of the nitrosating agent is best performed in the particular hydrocarbon fluid or process water to be treated. The in-situ generation takes into account the relatively unstable nature of the nitrous acid and allows for it to react with the amines present in the hydrocarbons and process streams present in a refinery.

Various means can be employed to generate the nitrosating agent in the hydrocarbon or process water stream. For example, nitrous acid can be generated by the acidification of nitrite salts:

$$Ba(NO_2)_2 + H_2SO_4 \rightarrow 2HNO_2 + Ba\ SO_4$$

Nitrous acid can also be formed by the thermal degradation of an organic nitrate:

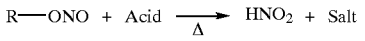

The present inventor anticipates that any means to generate the nitrosating agent in the hydrocarbon or the process fluid will be useful in the methods of the present invention.

The amines that can be treated by the methods of the present invention include but are not limited to those amines present in process streams and hydrocarbon streams. This can include primary amines, $RNH_2$; secondary amines, $R_2NH$; and, tertiary amines, $R_3N$.

The reaction between the nitrosating agent and the amines is a diazotization reaction. This reaction is typically performed at temperatures below ambient and rarely on aliphatic amines due to problems with the selectivity of products. Typical reactions between nitrous acid and amines are:

Primary aromatic

Diazonium Salt

Primary aliphatic

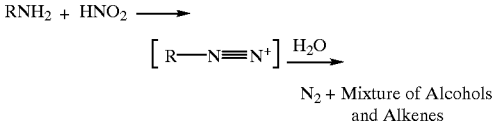

Secondary aromatic or aliphatic

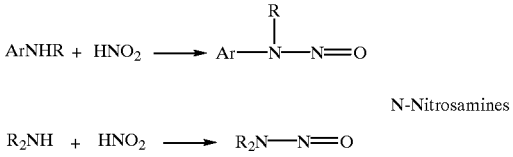

N-Nitrosamines

Tertiary aromatic

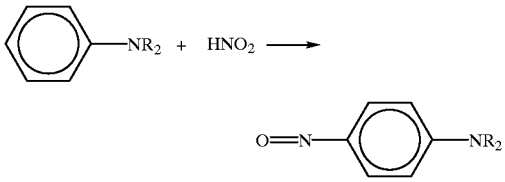

P-Nitroso compound

The methods of the present invention are expected to work during most refinery operations or processes. These processes include but are not limited to desalting, distillation, cracking and reforming. Other processes in a refinery include heating of the fraction being processed. Temperatures can often range from about ambient to about 1000° F. during these operations.

The phrase "hydrocarbon fluids" signifies various and sundry petroleum hydrocarbons and petrochemicals. Petroleum hydrocarbons include but are not limited to petroleum hydrocarbon feedstocks including crude oils and fractions thereof, such as naphtha, gasoline, kerosene, diesel, jet fuel, fuel oil, gas oil and vacuum residual.

Similarly, petrochemicals such as olefin or naphthenic process streams, aromatic hydrocarbons and their derivatives, ethylene dichloride and ethylene glycol may all be considered further non-limiting examples of hydrocarbon fluids.

The process waters may be any of the aqueous streams present in the refinery that can become contaminated with amines. These streams include straight water streams as well as emulsions.

The amount of nitrosating agent which needs to be generated is that amount which will react with the amines present in the hydrocarbon fluid or process stream within the residence time of the operating unit. This will of course vary from stream to stream, but will typically be in the range of about 1:1 to about 200:1.

In order to more clearly illustrate the invention, the data set forth below was developed. The following examples are included as being illustrations of the invention and should not be construed as limiting the scope thereof.

Experimental for Hydrocarbon Fluids 0.1% stock solutions were prepared of butylamine and dibutylamine in a 70/30 (v/v) heptane/toluene mixed solvent. The stock solutions were independently used as the hydrocarbon phase in a DEFS/DMVS (Desalter Electric Field Simulator/Desalter Mix Valve Simulator) emulsion test.

The water oil ratio in the emulsion test was 10/90. The water phase for the control tubes was deionized water and for experimental tubes it was 10% by weight $NaNO_2$ with 1 drop of a starch/Kl indicator and 2 drops of concentrated HCl added after the water had been placed in the test vessel. The vessel was immediately capped, mixed at 13,000 rpm for 3 seconds, then placed in the oil bath at 200° F. When eight tubes had been prepared, the electric field was turned on and the tubes were left in the field for 64 minutes. 10 mL aliquots were withdrawn from the hydrocarbon phase and were submitted for quantitative amine analysis by HPLC with a nitrogen sensitive detector.

The results of this testing are reported in Table I.

TABLE I

Amines in a Hydrocarbon Fluid from Mid-Western Refinery Concentrations are in mg/mL

TABLE I

Amines in a Hydrocarbon Fluid from Mid-Western Refinery Concentrations are in mg/mL

| | Test No. 1 | | Test No. 2 | | Test No. 3 | | Test No. 4 | |
|---|---|---|---|---|---|---|---|---|
| Sample ID | BA | DBA | BA | DBA | BA | DBA | BA | DBA |
| 1 | 650 | 0 | 190 | 0 | 0 | 680 | 0 | 45 |
| 2 | 650 | 0 | 170 | 0 | 0 | 740 | 0 | <10 |
| 3 | 650 | 0 | 170 | 0 | 0 | 740 | 0 | <10 |
| 4 | 620 | 0 | 75 | 0 | 0 | 740 | 0 | 16 |
| 5 | 640 | 0 | 150 | 0 | 0 | 720 | 0 | 13 |
| 6 | 640 | 0 | 94 | 0 | 0 | 720 | 0 | 52 |
| 7 | 640 | 0 | 88 | 0 | 0 | 700 | 0 | 17 |
| 8 | 640 | 0 | 79 | 0 | 0 | 680 | 0 | <10 |

Tests 1 and 3 are controls
Tests 2 and 4 are treated with HONO
BA = Butylamine
DBA = Dibutylamine As can be seen in Table I, the method of generating the nitrous acid showed reduction in the concentration of both primary and secondary amines in a hydrocarbon fluid.

For Process Waters

First, measure the pH of the process water sample. If pH>7, then use Method 1. If pH=5–6, then use Method 2. If pH<5, then use Method 3.

Method 1

Prepare a 10% $NaNO_2$ stock solution. Place 5 mL of process water in cap-able tube. Add 1 mL of stock solution to tube and cap the tube. Place tube in constant temperature bath and allow to come to temperature. Add acid to lower pH to 5–6 (nominally one drop of concentrate HCl). Mix using vortex genie. Return to temperature bath and allow to remain for about 30 minutes. Send sample for analysis.

Method 2

Prepare a 5% soluble starch 5% KI indicator solution. Prepare a 10% $NaNO_2$ stock solution, place stock solution vessel in constant temperature bath to bring to temperature. Place 5 mL of process water in a cap-able tube and add 2 drops of starch-KI indicator solution. Place tube in constant temperature bath and bring to temperature. Add 1 mL of $NaNO_2$ stock solution to tube, cap and mix on vortex genie. Return to constant temperature bath and allow to remain for about 30 minutes. Reserve sample for analysis.

Method 3

Add caustic to a sample aliquot to raise the pH to greater than 7. Prepare a 10% $NaNO_2$ stock solution. Place 5 mL of process water in a cap-able tube. Add 1 mL of stock solution to tube, cap the tube. Place tube in a constant temperature bath and allow it to come to temperature. Add acid to lower pH to 5–6 (nominally 1 drop of concentrated HCl). Mix using a vortex genie and return to constant temperature bath and allow to remain for about 30 minutes. Send sample for analysis via GC/NPD.

The results for process waters are presented in Table II.

TABLE II

Process Waters from Gulf Coast Refinery Desalter

| Sample No. | Monethanolamine (ppm) | N-Alkyl Morpholine (ppm) |
|---|---|---|
| Sample 1 | | |
| Blank | 6 | 81 |
| Repetition 1 | ND | 50 |
| Repetition 2 | ND | 60 |
| Sample 2 | | |
| Blank | 3 | 71 |
| Repetition 1 | ND | 60 |
| Repetition 2 | ND | 61 |
| Sample 3 | | |
| Blank | 4 | 65 |
| Repetition 1 | ND | 57 |
| Repetition 2 | ND | 57 |
| Sample 4 | | |
| Blank | 3 | 67 |
| Repetition 1 | ND | 56 |
| Repetition 2 | ND | 54 |

The results of this testing demonstrate that the method of generating nitrous acid in a process water lowers the concentration of both primary and tertiary amines.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for reducing the concentration of amine compounds in hydrocarbon fluids and process waters in a refinery process comprising generating a nitrosating agent in said fluids and waters in an amount sufficient to react with said amine compounds.

2. The method as claimed in claim 1 wherein said amine compound is selected from the group consisting of primary, secondary and tertiary amines.

3. The method as claimed in claim 1 wherein said nitrosating agent is selected from the group consisting of nitrous acid, peroxynitrous acid, nitrous acid complexes, organic nitrites, nitroprusside, NO, $NO_2$ and $NO_3$.

4. The method as claimed in claim 3 wherein said nitrous acid is generated by the acidification of nitrite salts.

5. The method as claimed in claim 3 wherein said nitrous acid is generated by reacting HCl and $NaNO_2$.

6. The method as claimed in claim 3 wherein said nitrous acid is generated by the thermal degradation of an organic nitrite.

7. The method as claimed in claim 1 wherein the reaction product of said amine compound and said nitrosating agent is a diazonium salt.

8. The method as claimed in claim 1 wherein said hydrocarbon fluid is selected from the group consisting of crude oil, naphtha, gasoline, kerosene, diesel, jet fuel, fuel oil, gas oil, vacuum residual, olefins or naphthenes, aromatic hydrocarbons, ethylene dichloride, and ethylene glycol.

9. The method as claimed in claim 1 wherein said process water is an emulsion.

10. The method as claimed in claim 1 wherein the amount of said nitrosating agent added to said hydrocarbon fluid or process stream is that amount which will react with the amines present within the residence time of the operating unit.

11. The method as claimed in claim 10 wherein from about 1:1 to about 200:1 nitrosating agent to amine is generated.

12. The method as claimed in claim 1 wherein said refinery process is selected from the group consisting of distillation, cracking and reforming.

13. The method as claimed in claim 1 wherein said refinery process has a temperature of about ambient to about 1000° F.

* * * * *